US010358613B2

(12) United States Patent
Kim

(10) Patent No.: US 10,358,613 B2
(45) Date of Patent: Jul. 23, 2019

(54) INDUSTRIAL HIGH-TEMPERATURE REFORMER AND REFORMING METHOD

(71) Applicant: Hyunyong Kim, Seoul (KR)

(72) Inventor: Hyunyong Kim, Seoul (KR)

( * ) Notice: Subject to any disclaimer, the term of this patent is extended or adjusted under 35 U.S.C. 154(b) by 0 days.

(21) Appl. No.: 15/568,989

(22) PCT Filed: Nov. 4, 2016

(86) PCT No.: PCT/KR2016/012639
§ 371 (c)(1),
(2) Date: Oct. 24, 2017

(87) PCT Pub. No.: WO2017/082590
PCT Pub. Date: May 18, 2017

(65) Prior Publication Data

US 2018/0127667 A1 May 10, 2018

(30) Foreign Application Priority Data

Nov. 13, 2015 (KR) ..... 10-2015-0159511

(51) Int. Cl.
*C10J 3/16* (2006.01)
*C10J 3/20* (2006.01)
(Continued)

(52) U.S. Cl.
CPC . *C10J 3/16* (2013.01); *C10J 3/20* (2013.01); *F23G 5/12* (2013.01); *F23G 7/00* (2013.01); *F24C 7/105* (2013.01); *F23G 2204/103* (2013.01); *F23G 2207/30* (2013.01); *F23G 2207/40* (2013.01)

(58) Field of Classification Search
CPC combination set(s) only.
See application file for complete search history.

(56) References Cited

U.S. PATENT DOCUMENTS 4,272,255 A * 6/1981 Coates ..... C10J 3/485 122/5
4,306,506 A * 12/1981 Rotter ..... C10J 3/26 110/229

(Continued)

FOREIGN PATENT DOCUMENTS

KR 100391121 B1 7/2003
KR 100637340 B1 10/2006

(Continued)

OTHER PUBLICATIONS

Decision of Patent Allowance dated Apr. 5, 2016 of corresponding Korean application No. 10-2015-0159511; 3 pgs.

(Continued)

*Primary Examiner* — Kaity V Chandler
(74) *Attorney, Agent, or Firm* — Maier & Maier, PLLC

(57) ABSTRACT

An industrial high temperature reformer and the reforming method in which a temperature of the reforming furnace is maintained at 1000° C. or higher by burning the coke, and a temperature of at least an upper half of the reforming furnace is maintained at 1200° C. or higher by burning the syngas, thereby producing syngas at a capacity of 500 $m^3$/hour or more by reforming all carbonaceous feedstock which is supplied to the reforming furnace.

7 Claims, 3 Drawing Sheets

(51) Int. Cl.

| | |
|---|---|
| ***F23G 5/12*** | (2006.01) |
| ***F23G 7/00*** | (2006.01) |
| ***F24C 7/10*** | (2006.01) |

(56) References Cited

U.S. PATENT DOCUMENTS 4,400,181 A * 8/1983 Snell ..... C10J 3/54 48/197 R
4,459,138 A * 7/1984 Soung ..... C10J 3/00 208/419
5,026,403 A * 6/1991 Michel-Kim ..... C10J 3/02 48/203
5,034,021 A * 7/1991 Richardson ..... C10G 1/002 201/34
6,083,862 A * 7/2000 Wheelock ..... C01B 17/508 423/638
6,333,015 B1 * 12/2001 Lewis ..... C10J 1/207 423/418.2
6,790,383 B2 9/2004 Kim
7,556,659 B2 7/2009 Kim
8,753,411 B2 6/2014 Kim
8,858,661 B2 10/2014 Kim
8,997,664 B2 * 4/2015 Broglio ..... F23G 5/027 110/185
2002/0069798 A1 * 6/2002 Aguadas Ellis ..... C10J 3/06 110/229
2002/0095866 A1 * 7/2002 Hassett ..... C01B 3/36 48/199 FM
2003/0106266 A1 * 6/2003 Bryan ..... F02C 3/20 48/197 FM
2004/0232046 A1 * 11/2004 Tanaka ..... C01B 3/34 208/107
2006/0265954 A1 * 11/2006 Dogru ..... C10J 3/22 48/197 R
2007/0012229 A1 * 1/2007 Rehmat ..... C10J 3/26 110/229
2009/0165382 A1 * 7/2009 Rappas ..... C10J 3/00 48/127.7
2009/0188165 A1 * 7/2009 Ariyapadi ..... C10J 3/463 48/210
2010/0024300 A1 * 2/2010 Chornet ..... C01B 3/52 48/203
2010/0051875 A1 * 3/2010 Chornet ..... C01B 3/52 252/373
2010/0155669 A1 * 6/2010 Tsang ..... C10J 3/56 252/373
2010/0314583 A1 * 12/2010 Banerjee ..... C10G 11/16 252/373
2011/0088321 A1 * 4/2011 Kim ..... C10B 49/02 48/89
2011/0116979 A1 * 5/2011 Yamamoto ..... C10J 3/485 422/162
2011/0179762 A1 7/2011 Kim
2012/0036777 A1 * 2/2012 Patel ..... C10J 3/08 48/197 R
2012/0061618 A1 * 3/2012 Santoianni ..... C04B 28/04 252/373
2012/0199795 A1 * 8/2012 Gorodetsky ..... C10J 3/18 252/373
2012/0271072 A1 * 10/2012 Robinson ..... C10J 3/463 585/240
2014/0158941 A1 * 6/2014 Liu ..... C10J 3/482 252/373
2016/0186276 A1 * 6/2016 Winter ..... C21B 13/0033 75/444
2017/0037328 A1 * 2/2017 Wormser ..... C10J 3/66
2018/0057762 A1 * 3/2018 Lucas ..... C07C 29/1518
2018/0086994 A1 * 3/2018 Kresnyak ..... C10J 3/26

FOREIGN PATENT DOCUMENTS

KR 20-0434845 Y1 12/2006
KR 100887137 B1 3/2009
KR 20110044316 A 4/2011
KR 20130072703 A 7/2013
WO 2010035430 A1 2/2012

OTHER PUBLICATIONS

International Search Report dated Feb. 3, 2017 of corresponding International application No. PCT/KR2016/012639; 5 pgs.
H. Y. Kim, "A low cost production of hydrogen from carbonaceous wastes", International Journal of Hydrogen Energy 28 (2003), pp. 1179-1186.
Kim Hyun Yong, "Method of gasification in IGCC system", International Journal of Hydrogen Energy 32 (2007), pp. 5088-5093.

* cited by examiner

INDUSTRIAL HIGH-TEMPERATURE REFORMER AND REFORMING METHOD

TECHNICAL FIELD

The present invention relates to an industrial high temperature reformer (aka Kim reformer-XT) which is obtained by improving a high temperature reformer (Korean Patent No. 0637340) patented to the present applicant, i.e., a small-sized experimental reformer (aka Kim reformer). In the process, its production capacity of syngas has improved from 100 $m^3$/hour to 500 $m^3$/hour or more, and also relates to its reforming method.

BACKGROUND ART

The high temperature reformer technology began when the German chemist Lurgi suggested a coal-gas reaction($C+H_2O \rightarrow CO+H_2$). Before the present applicant disclosed the patented high temperature reformer (patent documents 1 through 7), the coal-gas reaction was limited to coal gasification; ground coal is combusted with oxygen gas in order to bring up the reactor temperature, and then hot steam is injected into the coal furnace. This method of coal gasification is known as the partial oxidation method, and the resulting reaction temperature runs just around 1,000° C., and a mixture of hydrocarbons are generated. However syngas($CO+H_2$) after extensive gas separation amounts to about 5% of total gas mixture produced. Furthermore, the temperature of the reforming furnace could not be maintained at 1200° C. or higher by burning coal. Currently, it is known that only the SASOL company of South Africa maintains an economical syngas production.

At the end of the last century, the present applicant reexamined the Lurgi coal-gas reaction. The results of the experiment (see non-patent document 1) were significantly different from the facts which were widely known at the time. The results of the experiment were as in the following. 1) The temperature at which all carbon reformed without catalyst to carbon monoxide gas and all hydrogen atom reduced into $H_2$ gas was just above 1200° C.; 2) Not only carbon of coal, but of all carbonaceous substance reformed into carbon monoxide (CO) at 1200° C. or higher; 3) At the temperature above 1200° C., all hydrocarbons including methane disappeared quickly, and all other hydrocarbons were not detected by a gas detector. The only detected carbon species were CO and $CO_2$. Since the gas generated at a temperature of 1200° C. or higher did not contain any carbon species except for CO gas, unlike in a conventional gasification method, it was not necessary to carry out the gas separation process. The present applicant conducted additional experiments with great interest in the results of 2). The experiments were conducted on a waste tire, crude rubber, synthetic resin and biomass, and only biomass had a problem. The reason for this is that biomass contains a large amount of moisture, and thus the region near the carbons of biomass could not be heated to a temperature of 1200° C. within a short period of time. In particular, the carbon reforming reaction was an endothermic reaction, and a heat of 1200° C. required for the reforming reaction was not supplied to the carbons.

When the present applicant became aware that the Lurgi coal-gas reaction reached the thermal equilibrium at 1200° C., the present applicant constructed a reforming furnace capable of maintaining a temperature of 1200° C., i.e., the most efficient condition for the reaction. The reforming furnace was named Kim reformer (see patent document 1), and was constructed for experimental purposes.

However, the Kim reformer merely produces syngas at a capacity of 100 $m^3$/hour, and has a problem in that 30% of generated syngas has to be burnt and used as heat source for the purpose of the continuous operation thereof. In other words, for the Kim reformer to be widely used for industrial purposes, the reformer can be said to be economic only when the reformer can produce syngas at a capacity of 500 $m^3$/hour or more.

SUMMARY OF THE DISCLOSURE

The object of the present invention is to provide an industrial high temperature reformer and the reforming method which can produce syngas at a capacity of 500 $m^3$/hour or more. In the industrial high temperature reformer and the reforming method, a temperature of the reforming furnace is maintained at 1000° C. or higher by burning the coke, and a temperature of at least an upper half of the reforming furnace is maintained at 1200° C. or higher by burning the syngas, thereby reforming all carbonaceous feedstock which is supplied to the reforming furnace.

In order to accomplish the above object, the present invention provides an industrial high temperature reformer comprising: a reforming furnace reforming carbonaceous feedstock; a carbonaceous feedstock inlet supplying carbonaceous feedstock to the reforming furnace; a coke supply unit supplying coke to the reforming furnace; a first oxygen inlet supplying oxygen to the reforming furnace; a steam inlet supplying steam to the reforming furnace; a syngas outlet formed in an upper section of the reforming furnace; and a syngas inlet supplying syngas to the reforming furnace; wherein a temperature of the reforming furnace is maintained at 1000° C. or higher by burning the coke with the oxygen, and a temperature of at least an upper half of the reforming furnace is maintained at 1200° C. or higher by burning the syngas supplied via the syngas inlet.

In this case, the first oxygen inlet can be formed in the lower section of the reforming furnace, and a second oxygen inlet can be formed in the mid-section of the reforming furnace. The two carbonaceous feedstock inlets can be formed in the mid-section of the reforming furnace, and the second oxygen inlet can be formed in between the two carbonaceous feedstock inlets.

The oxygen supplied to the reforming furnace can be fully used up to burn the coke and the syngas supplied via the syngas inlet. The syngas supplied via the syngas inlet can be part of syngas discharged via the syngas outlet, and the high temperature syngas discharged via the syngas outlet can pyrolyze the carbonaceous feedstock and be then cooled.

Furthermore, the present invention provides the industrial high temperature reforming method comprising: a first step of supplying coke to a reforming furnace; a second step of supplying oxygen to the reforming furnace, and maintain a temperature of the reforming furnace at 1000° C. or higher by burning the coke; a third step of supplying steam to the reforming furnace; a fourth step of maintaining a temperature of at least an upper half of the reforming furnace at 1200° C. or higher by burning a gas mixture ($CO_2$, $H_2O$, CO, and $H_2$) generated through the burning of the coke and the steam and/or syngas supplied to the reforming furnace; and a fifth step of supplying carbonaceous feedstock to the reforming furnace, and generating syngas by reforming the carbonaceous feedstock.

In this case, the oxygen used to burn the coke at the second step may be supplied via a lower section of the reforming furnace, and the oxygen used to burn the gas mixture and/or syngas at the fourth step may be supplied via a mid-section of the reforming furnace. The syngas at the fourth step may be part of the syngas generated at the fifth step, and the high temperature syngas generated at the fifth step may pyrolyze the carbonaceous feedstock and be then cooled.

In an industrial high temperature reformer (Kim reformer-XT) according to the present invention, the overall reforming furnace is maintained at 1000° C. or higher by using an abundant coke pile as the main heat source, and at least the upper half of the reforming furnace is maintained at 1200° C. or higher by using syngas as an auxiliary heat source, thereby providing the effect of rapidly reforming carbonaceous feedstock in a gaseous state and generating syngas.

DETAILED DESCRIPTION

Figure 1:
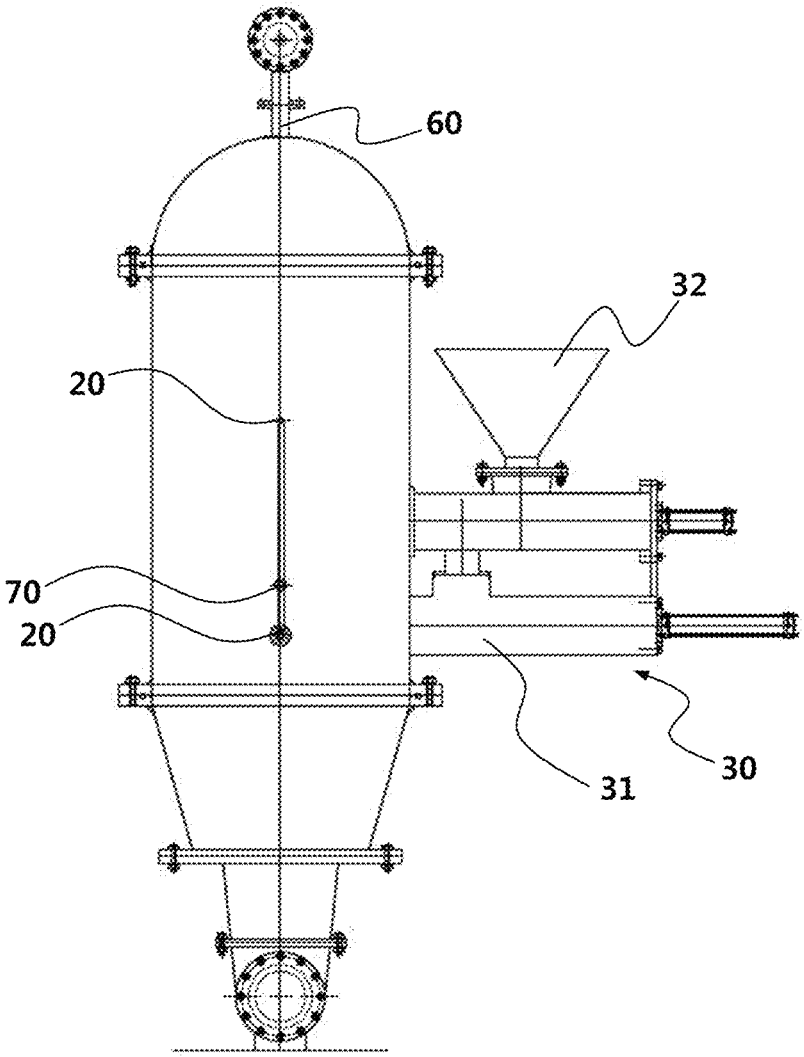
FIG. 1 is a front view showing an industrial high temperature reformer according to the present invention.
Figure 2:
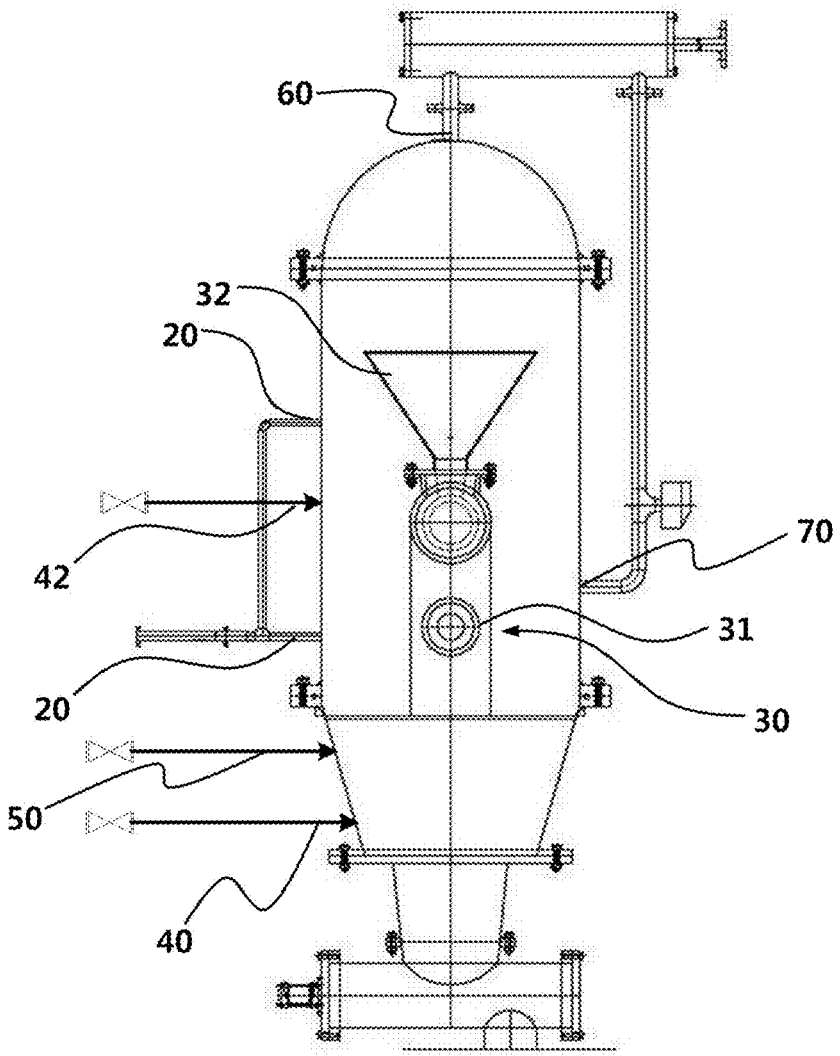
FIG. 2 is a right side view showing the industrial high temperature reformer according to the present invention.
Figure 3:
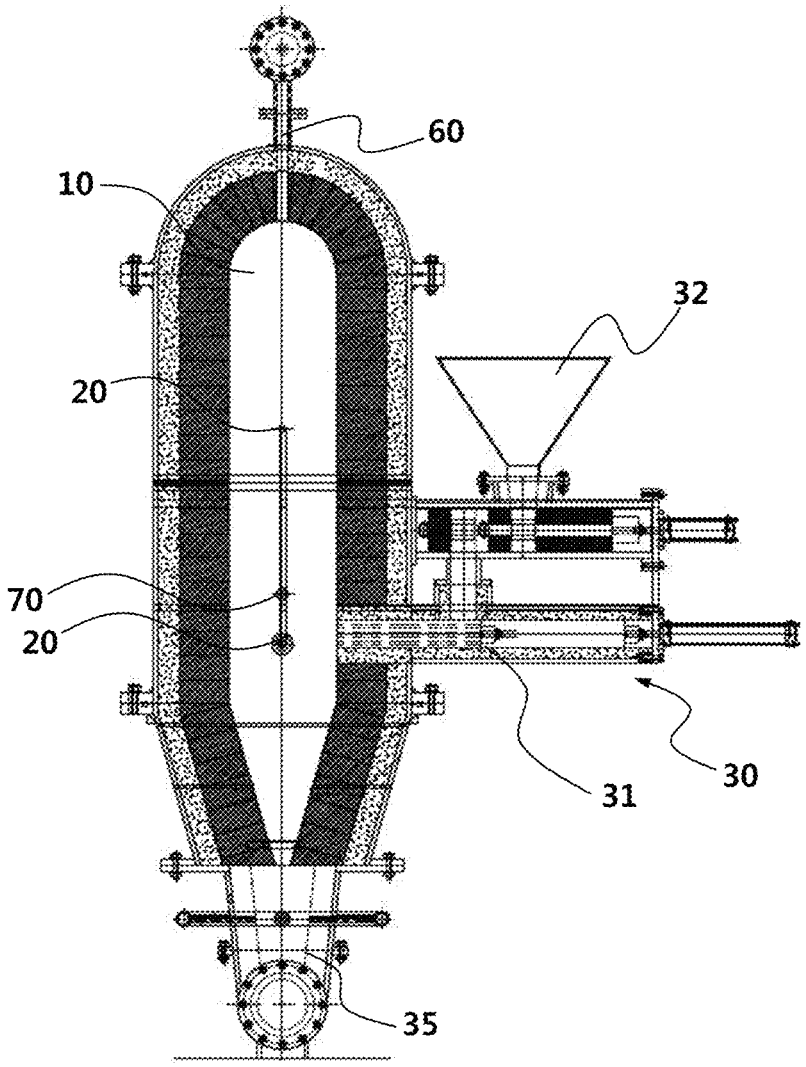
FIG. 3 is a longitudinal sectional view showing the industrial high temperature reformer according to the present invention.

FIG. 1 shows a front of an industrial high temperature reformer according to the present invention, FIG. 2 shows a right side of the industrial high temperature reformer according to the present invention, FIG. 3 shows a longitudinal section of the industrial high temperature reformer according to the present invention.

The present invention provides an industrial high temperature reformer comprising: a reforming furnace 10 reforming carbonaceous feedstock; a carbonaceous feedstock inlet 20 supplying carbonaceous feedstock to the reforming furnace 10; a coke supply unit 30 supplying coke to the reforming furnace 10; a first oxygen inlet 40 supplying oxygen to the reforming furnace 10; a steam inlet 50 supplying steam to the reforming furnace 10; a syngas outlet 60 formed in an upper section of the reforming furnace 10; and a syngas inlet 70 supplying syngas to the reforming furnace 10; wherein a temperature of the reforming furnace 10 is maintained at 1000° C. or higher by burning the coke with the oxygen, and a temperature of at least an upper half of the reforming furnace 10 is maintained at 1200° C. or higher by burning the syngas supplied via the syngas inlet 70.

An industrial high temperature reformer (Kim reformer-XT) according to the present invention is a significantly efficient reformer which generates syngas by reforming carbons, constituting all the carbonaceous feedstock, into carbon monoxide CO without a catalyst and then reducing hydrogen into hydrogen gas. The temperature of the reforming furnace 10 may be maintained at 1000° C. or higher by heat generated in the coke pile, and the temperature of at least the upper half of the reforming furnace may be continuously maintained at 1200° C. or higher by circulating a portion of the syngas generated at 1200° C. or higher and burning it. It burns just enough syngas required for maintaining the temperature of the at least the upper half of the reforming furnace 10 at 1200° C. or higher, rather than the whole reforming furnace 10. This mechanism may be viewed as a significantly energy efficient invention.

The reforming furnace 10 has the height of 3 m and the outer diameter of 1 m. The carbonaceous feedstock inlets 20 are formed about the mid-section of the reforming furnace 10, one above the mid-section and the other below it. When the temperature of the upper half of the reforming furnace 10 reaches to 1200° C. or higher, gaseous carbonaceous substance and well ground (μm size) powder form of carbon react quickly to generate syngas. However when the feedstock is liquid or solid, it takes time for carbon atoms of liquid or solid feedstock to come to a thermal equilibrium with surrounding temperature of 1200° C. Although in the case of coal, the time may be reduced by finely grinding coal to micrometer size, significant energy consumption may occur during this process. Accordingly, if coal is pyrolyzed and reduced into flue gas, and oil, and then injected into the reformer, a rapid reforming may follow and syngas is generated. Waste plastics may also be pyrolyzed as in the case of coal, or a pyrolyzer may be directly connected to the carbonaceous feedstock inlet 20 and carbonaceous feedstock (flue gas, and oil) obtained through pyrolysis may be supplied.

In particular, biomass has a large amount of moisture, and thus tar is left even when biomass is dried. However, tar is the main source of carbons, and thus a large amount of syngas can be obtained by continuously reforming tar.

In the case of food waste, hydrocarbon may be separated from water via a hydrogenation process (see Korean Patent 1146582 issued to the present applicant). Since the temperature of the syngas outlet 60 is equal to or higher than 1200° C., the high temperature syngas generated in the reformer may be used as a heat source required for the high temperature hydrolysis of food waste to recover the hydrocarbons from the food waste.

When a large number of carbon sources are obtained by performing appropriate preprocessing of waste, biomass, etc. and then reforming is performed, a large amount of syngas can be produced, and hydrogen gas, other renewable energy resources and various chemical materials can be produced.

A coke supply unit 30 configured to supply coke is formed in the lower part of the mid-section of the reforming furnace 10, and the coke supply unit 30 may include a supply pipe 31 configured such that a transfer screw is formed therein and a hopper 32 formed above the supply pipe 31 and may be modified into various forms, such as a hydraulic cylinder, a blower, and the like. Petroleum coke or coal coke generated during coal gasification may be used. In Korea, oil refinery companies treat petroleum coke as waste, and thus using petroleum coke as the main heat source is recommended as being renewables.

A first oxygen inlet 40 configured to supply oxygen is formed in the lower section of the reforming furnace 10. The coke supplied by the coke supply unit 30 is stacked in the lower section of the reforming furnace 10, and the first oxygen inlet 40 supplies oxygen to a pile formed by the stacked coke. Furthermore, a steam inlet 50 configured to supply steam is formed above the first oxygen inlet 40, a syngas inlet 70 configured to supply syngas is formed in the mid-section of the reforming furnace 10, a second oxygen inlet 42 may be formed between the two carbonaceous feedstock inlets 20, and an ash remover 35 is formed at the lower end of the reforming furnace 10.

The coke pile supplied via the coke supply unit 30 and located in the lower section of the reforming furnace 10 is burnt along with the oxygen supplied via the first oxygen inlet 40, and provides high temperature heat equal to or higher than 1500° C. A gas mixture ($CO_2$, $H_2O$, CO, and $H_2$;

generated from the burning of the coke and the use of the steam supplied via the steam inlet) generated in the coke pile rises up to the upper section of the reforming furnace 10, and maintains the temperature of the entire reforming furnace 10 at 1000° C. or higher. The gas mixture and/or syngas (supplied via the syngas inlet 70) may be burnt, and maintain the temperature of at least the upper half of the reforming furnace 10 at 1200° C. or higher. When the temperature of the upper half of the reforming furnace 10 is maintained at 1200° C. or higher, the carbonaceous feedstock entering via the carbonaceous feedstock inlets 20 is reformed and generates syngas, and the generated syngas is discharged via the syngas outlet 60 formed in the upper section of the reforming furnace 10 and is then stored. In this case, a portion of the syngas discharged from the syngas outlet 60 may be redirected to the reforming furnace 10 via the syngas inlet 70, is burnt therein, and continuously maintains the temperature of at least the upper half of the reforming furnace 10 at 1200° C. or higher.

In other words, the overall reforming furnace 10 is maintained at 1000° C. or higher by the burning of the coke, and the temperature of at least the upper half of the reforming furnace 10 is increased to 1200° C. or higher by burning a small amount of syngas ($CO+H_2$) generated in the coke pile and/or the syngas supplied via the syngas inlet 70. Thereafter, reforming is sustained by injecting carbonaceous feedstock. A sufficient amount of the generated syngas is transferred to the upper half of the reforming furnace thru circulating a portion of the generated syngas. The generated syngas is to supplement the syngas rising from the coke pile, thereby providing the heat source required for the endothermic reforming reaction. When the upper half of the reforming furnace maintains the thermal equilibrium at the 1200° C. or higher, the reforming reaction takes place very rapidly.

In this case, in order to activate the burning of the gas mixture (generated through the burning of the coke and the use of the steam supplied via the steam inlet) and/or the syngas (supplied via the syngas inlet 70), a second oxygen inlet 42 may be formed at the mid-section of the reforming furnace 10, and the upper half of the reforming furnace 10 may be effectively maintained at 1200° C.

The oxygen inside the reforming furnace 10 is completely used up to burn the coke, the gas mixture (generated through the burning of the coke and the use of the steam supplied via the steam inlet), and the syngas (supplied via the syngas inlet), and thus no oxygen is detected in the syngas outlet 60. There should be no oxygen left within the reforming furnace 10 at all time, strictly oxygen deficient mode.

It is preferred that the oxygen supplied via the first oxygen inlet 40 is completely used up to burn the coke and that the oxygen supplied via the second oxygen inlet 42 is used to burn the gas mixture (generated through the burning of the coke and the use of the steam supplied via the steam inlet) and/or the syngas (supplied via the syngas inlet).

The high temperature syngas discharged via the syngas outlet 60 is cooled via a pyrolyzing furnace in which biomass, coal, or the like, i.e., solid or liquid carbonaceous feedstock, is pretreated, and the syngas having the remaining heat is cooled to room temperature and stored in a storage tank.

The present invention provides the industrial high temperature reforming method comprising: the first step of supplying coke to a reforming furnace; the second step of supplying oxygen to the reforming furnace, and maintain a temperature of the reforming furnace at 1000° C. or higher by burning the coke; the third step of supplying steam to the reforming furnace; the fourth step of maintaining a temperature of at least an upper half of the reforming furnace at 1200° C. or higher by burning a gas mixture ($CO_2$, $H_2O$, CO, and $H_2$) generated through the burning of the coke and the steam and/or syngas supplied to the reforming furnace; and the fifth step of supplying carbonaceous feedstock to the reforming furnace, and generating syngas by reforming the carbonaceous feedstock.

The first step is the step of supplying coke to the reforming furnace 10 via the coke supply unit 30. The supplied coke is congregated in the lower section of the reforming furnace 10, and forms a coke pile.

The second step is the step of supplying oxygen to the reforming furnace 10, and maintaining the temperature of the reforming furnace 10 at 1000° C. or higher by burning the coke. At the third step, steam is supplied to the reforming furnace 10 via the steam inlet 50.

The fourth step is the step of maintaining the temperature of at least the upper half of the reforming furnace 10 at 1200° C. or higher. The temperature of at least the upper half of the reforming furnace 10 is increased to 1200° C. or higher by burning a gas mixture ($CO_2$, $H_2O$, CO, and $H_2$) generated through the burning of the coke and the use of the steam and/or the syngas supplied to the reforming furnace 10 via the syngas inlet 70.

When the temperature of the at least the upper half of the reforming furnace 10 is maintained at 1200° C. or higher, carbonaceous feedstock is supplied to the reforming furnace 10 via the carbonaceous feedstock inlets 20, syngas is generated by reforming the carbonaceous feedstock, and the generated syngas is discharged via the syngas outlet 60.

In this case, the oxygen used to burn the coke at the second step can be supplied via the first oxygen inlet 40 which is formed in a lower section of the reforming furnace 10, and the oxygen used to burn the gas mixture or syngas at the fourth step can be supplied via the second oxygen inlet 42 which is formed at the mid-section of the reforming furnace 10. The syngas at the fourth step can be part of the syngas generated at the fifth step, and the high temperature syngas generated at the fifth step can pyrolyze the carbonaceous feedstock and be then cooled.

A main heat source is the coke pile located in the lower section of the reforming furnace 10. A high temperature of 1500 to 1800° C. is generated by burning the coke along with the oxygen. When steam is gradually supplied over the coke pile located in the lower section of the reforming furnace 10 via the steam inlet 50, a gas mixture ($CO_2$, $H_2O$, CO, and $H_2$) rises up and heats the overall reforming furnace 10 to 1000° C. or higher. When hydrogen gas $H_2$ is continuously detected at the syngas outlet 60, oxygen gas $O_2$ is gradually injected in small amounts via the second oxygen inlet 42. When the amount of syngas generated in the coke pile is increased by increasing the supply of the steam via the steam inlet 50 and the temperature of the upper half of the reforming furnace 10 reaches 1200° C. or higher by carefully increasing the oxygen injected via the second oxygen inlet 42, carbonaceous feedstock is introduced via the carbonaceous feedstock inlets 20. A part of the syngas (<10%) discharged via the syngas outlet 60 is supplied to the reforming furnace 10 via the syngas inlet 70. The purpose of the supplied syngas is to exhaust the oxygen gas entering via the first oxygen inlet 40 and/or second oxygen inlet 42 and to maintain the temperature of the upper half of the reforming furnace 10 at 1200° C. or higher. A region above 1200° C. is a region in which the heat balance and the reforming reaction to start are established, and therefore the reforming reaction takes place most efficiently without the presence of a catalyst. The syngas production capacity of the industrial high temperature reformer (Kim reformer-XT) according to the present invention is 500 $m^3$ or more. When the temperature of the upper half of the reforming furnace 10 is decreased to 1200° C. or lower, the supply of the carbonaceous feedstock may be stopped and the process may be re-started, or the amounts of syngas supplied to the syngas inlet 70 may be increased, and then the oxygen supply.

Although the preferred embodiments of the present invention have been disclosed for illustrative purposes, those skilled in the art will appreciate that the scope and spirit of the present invention are not limited to these embodiments, and various modifications, additions and substitutions are possible, without departing from the scope and spirit of the invention as disclosed in the accompanying claims.

The present invention can produce syngas at a capacity having improved from 100 $m^3$/hour to 500 $m^3$/hour or more by improving a small-sized experimental reformer into an industrial reformer.

The invention claimed is:

1. An industrial high temperature reformer comprising:

a reforming furnace reforming carbonaceous feedstock; a carbonaceous feedstock inlet supplying carbonaceous feedstock to the reforming furnace; a coke supply unit supplying coke to the reforming furnace; a first oxygen inlet supplying oxygen to the reforming furnace; a steam inlet supplying steam to the reforming furnace; a syngas outlet formed in an upper section of the reforming furnace; and a syngas inlet supplying syngas to the reforming furnace;

wherein the first oxygen inlet is formed in a lower section of the reforming furnace inserting a first oxygen into the lower section of the reforming furnace to maintain a temperature of the reforming furnace at 1000° C. or higher by burning the coke with the first oxygen, wherein a second oxygen inlet and the syngas inlet are formed in the mid-section of the reforming furnace inserting a second oxygen into the mid-section of the reforming furnace to maintain a temperature of at least an upper half of the reforming furnace at 1200° C. or higher by burning the syngas supplied via the syngas inlet with the second oxygen, wherein the second oxygen inlet is provided on a first height of the reforming furnace, wherein the syngas inlet is provided on a second height of the reforming furnace, and wherein the first height is above the second height.

2. The industrial high temperature reformer of claim 1, wherein two carbonaceous feedstock inlets are formed in the mid-section of the reforming furnace, and the second oxygen inlet is formed between the two carbonaceous feedstock inlets.

3. The industrial high temperature reformer of claim 1, wherein the oxygen supplied to the reforming furnace is fully used up to burn the coke and the syngas supplied via the syngas inlet.

4. The industrial high temperature reformer of claim 1, wherein the syngas supplied via the syngas inlet is part of syngas discharged via the syngas outlet, and the high temperature syngas discharged via the syngas outlet pyrolyzes the carbonaceous feedstock and is then cooled.

5. An industrial high temperature reforming method comprising:

a first step of supplying coke to the reforming furnace of claim 1;

a second step of supplying oxygen to the reforming furnace, and maintaining a temperature of the reforming furnace at 1000° C. or higher by burning the coke;

a third step of supplying steam to the reforming furnace;

a fourth step of maintaining a temperature of at least an upper half of the reforming furnace at 1200° C. or higher by burning a gas mixture (CO2, H20, CO, and H2) generated through the burning of the coke and the steam or syngas supplied to the reforming furnace; and a fifth step of supplying carbonaceous feedstock to the reforming furnace, and generating syngas by reforming the carbonaceous feedstock.

6. The industrial high temperature reforming method of claim 5, wherein the oxygen used to burn the coke at the second step is supplied via a lower section of the reforming furnace, and the oxygen used to burn the gas mixture or syngas at the fourth step is supplied via the mid-section of the reforming furnace.

7. The industrial high temperature reforming method of claim 5, wherein the syngas at the fourth step is part of the syngas generated at the fifth step, and the high temperature syngas generated at the fifth step pyrolyzes the carbonaceous feedstock and is then cooled.

* * * * *